United States Patent [19]

Tinnes et al.

[11] Patent Number: 4,602,768

[45] Date of Patent: Jul. 29, 1986

[54] APPARATUS FOR DETERMINING THE PRESENCE OF A METALLIC MELT IN A PASSAGE CHANNEL OF A METALLURGICAL FURNACE OR OF A CASTING LADLE

[75] Inventors: Bernard Tinnes, Zollikerberg; Bernard Knell, Thalwil, both of Switzerland

[73] Assignee: Metacon AG, Zurich, Switzerland

[21] Appl. No.: 640,601

[22] Filed: Aug. 14, 1984

[30] Foreign Application Priority Data

Aug. 18, 1983 [CH] Switzerland ..... 4506/83

[51] Int. Cl.[4] ..... C21B 7/24

[52] U.S. Cl. ..... 266/99; 266/236

[58] Field of Search ..... 266/93, 94, 99, 78, 266/45, 227, 236

[56] References Cited

U.S. PATENT DOCUMENTS 4,140,300 2/1979 Gruner et al. ..... 266/45

FOREIGN PATENT DOCUMENTS 2532208 4/1984 France ..... 266/99

OTHER PUBLICATIONS

Studsvik Report, "The Emli Slag Indication System", 1982-03-09.

*Primary Examiner*—L. Dewayne Rutledge
*Assistant Examiner*—S. Kastler
*Attorney, Agent, or Firm*—Cushman, Darby & Cushman

[57] ABSTRACT

Into an opening (11) in the bottom part or wall part (2) of a smelting furnace (1) or of a casting ladle, a hollow cylindrical carrier element (7) is inserted which, for example, is releasably connected by means of screws with this bottom or wall part (2). This carrier element (7) surrounds an outlet casing (6) made of refractory material in which a channel of passage (5) for the melt is provided. At places facing each other with regard to the channel of passage (5), recesses (13, 14) are formed in the carrier element (7) in the manner of annular grooves. In each of these recesses (13, 14), there is a coil (17, 19) which is protected from a direct contact with the outlet casing (6) by sections of wall (15, 16) forming the bottom of the recesses (13, 14). One of the coils (17) may be connected with an AC current source for the production of a magnetic field, while the second, opposite coil (19) is connected to an evaluation circuit in which the signals induced in this second coil (19) are evaluated. As a result of the attachment of the coils (17, 19) in a carrier element (7) separated from the wall or bottom part (2), the installation and dismantling of the coils (17, 19) has been simplified. Moreover, the danger of damage to the coils (17, 19) does not exist in the case of a renewal of the outlet casing (6).

9 Claims, 2 Drawing Figures

APPARATUS FOR DETERMINING THE PRESENCE OF A METALLIC MELT IN A PASSAGE CHANNEL OF A METALLURGICAL FURNACE OR OF A CASTING LADLE

The present invention relates to an apparatus for determining the presence of a metallic melt in a passage or outlet channel of a metallurgical furnace or of a casting ladle formed by a body made of refractory material.

When cutting off of smelting furnaces, for example, converters, electrofurnaces, Siemens-Martin furnaces, one must be careful that to the extent possible no slag will reach the casting ladle. A corresponding requirement also exists in the case of pouring a melt through the bottom outlet of a casting ladle into a receiving vessel, for example, into a distributor of a continuous casting installation or into permanent molds. In order to be able to prevent slag from being tapped or poured together with the melt, on the one hand, an early detection of the slag in the vicinity of the outlet toward the end of the tapping or pouring operation, and, on the other hand, a quick interruption of the outflow, will be necessary. At the same time however, it is undesirable to interrupt the outflow too early, since in such a case still considerable quantities of metal melt will remain behind in the furnace or in the ladle.

The requirement of a quick interruption of the outflow may be fulfilled for example by way of sliding closures of a known construction without great difficulties. For the early detection of the slag, that is to say an early indication of the end of the tapping or pouring operation, various measures have already been proposed which are directed either to the use for pouring ladles and therefore are not suitable for the use in the case of smelting furnaces or which under the rough conditions prevailing in a steel plant, do not operate reliably. (See German AS No. 26 37 421, German OS No. 28 15 137 as well as German AS No. 28 14 699).

An apparatus for determining the presence of a metallic melt in an outlet channel of a metallurgical furnace having a transmitter and a receiver associated with said channel is already known. In the case of this apparatus, two coils are disposed opposite one another with regard to the passage for the melt, which are protected by the refractory lining of the tapping channel or outlet passage from any contact with the melt. The one coil (transmitter) is fed with alternating voltage and produces a magnetic field which on its part induces signals in the outer coil (receiver). As soon as the flow through the outlet passage no longer is a metallic melt only but becomes a mixture of metallic melt and slag, these signals change. These signal changes are determined in an evaluation circuit and are used for an immediate interruption of the outflow. Now, as is well known, the lining of the tapping channel must be renewed periodically, that is to say it must be broken out. When that is being done, care must be taken that the transmitter and receiver coils will not be damaged.

The present invention aims at creating an apparatus of the initially mentioned type which permits an easy installation of a transmitter and receiver in a certain mutual position as well as a replacement of the transmitter and receiver without problems and in the case of which damage to the transmitter and receiver during the renewal of the refractory lining may be avoided.

The attachment of the transmitter and receiver in the correct mutual position on the carrier element may take place away from the installation site in a surrounding suitable for an operation requiring mechanical precision work. The installation of the carrier element provided with the transmitter and the receiver on the furnace or on the ladle will then be relatively easy. Since the transmitter and the receiver are disposed in a protected position on or in the carrier element, there will be no danger of damage of the transmitter and carrier during the breaking out of the refractory material surrounding the channel of passage. A replacement of the former presents no difficulties, since only the carrier element needs to be replaced, which is releasably connected with a furnace or ladle part, by a new carrier element. At the same time, it will be ensured that the transmitter and the receiver of the new carrier element assume the same position as the transmitter and the receiver of the removed carrier element. As a result an expensive realignment will be avoided.

In order to effectively protect the transmitter and receiver from a contact with the body of refractory material, the transmitter and the receiver are disposed preferably at a distance from the inside of the carrier element facing the refractory body. This may take place in the case of a particularly effective embodiment which is simple in its production through the fact that the transmitter as well as the receiver are disposed in a recess which is closed against the inside of the carrier element. In this case, the transmitter and the receiver are separated from the refractory body by a wall formed from the material of the carrier element.

As a material for the carrier element, a nonmagnetic material is particularly suitable which will not influence the magnetic coupling between transmitter and receiver in a disadvantageous manner. Preferably, a material will be used for the carrier element which moreover is heat resistant, preferably austenitic steel.

Whenever the carrier element is provided with a cooling arrangement, for example, with at least one channel for a cooling medium, it is also conceivable to use a less heat resistant material for the carrier element.

In the following paragraphs, an embodiment of the invention by way of example will be explained in more detail on the basis of the drawing.

Purely schematically, there is shown in:

FIG. 1, the area of the outlet of the smelting furnace in section, and

FIG. 2, the carrier element in a perspective presentation.

DETAILED DESCRIPTION OF THE DRAWINGS

Figure 1:
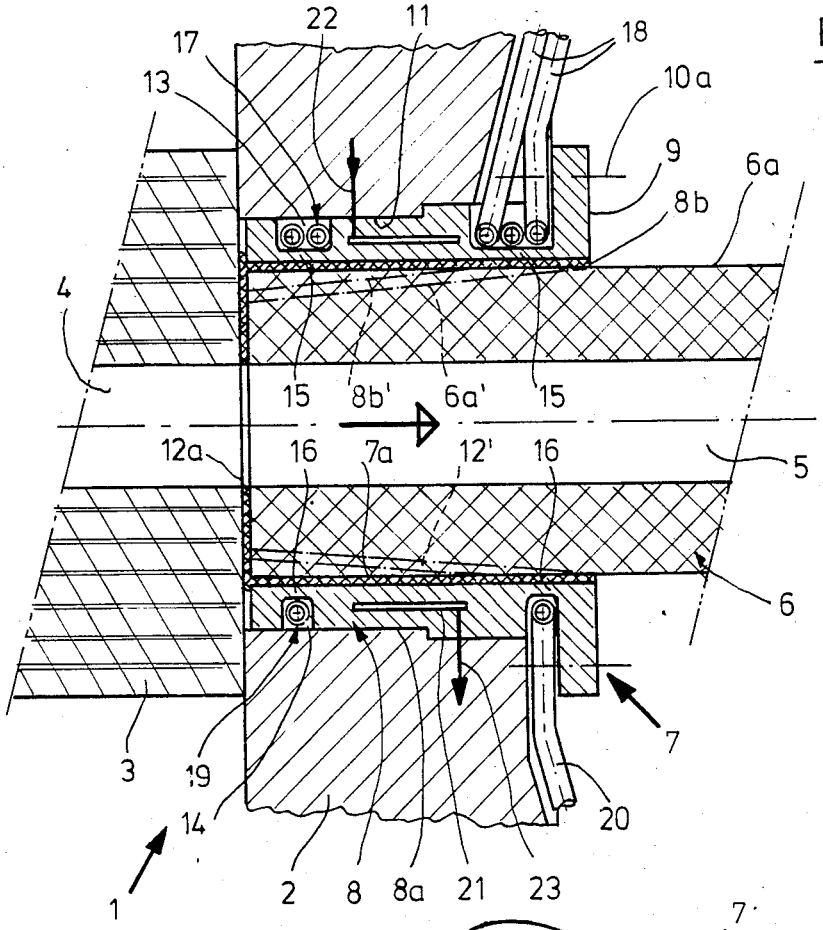

In FIG. 1, which represents the area of the outlet of a smelting furnace 1, only a wall or bottom part 2 of this furnace 1 is shown. On the inside of said furnace, a hollow stone or annular body 3 of refractory material defining a flow channel 4 is disposed. This flow channel 4 is aligned with an outlet channel 5 which is formed in a tubular outflow or discharge casing 6 made of refractory material. This outflow casing 6 is surrounded by an annular carrier element 7, through opening 7*a* of which the outlet casing 6 extends. The carrier element 7 is formed of a hollow cylndrical body 8 which carries a flange 9 provided with bores 10 for the accomodation of attaching screws, not shown. The carrier element 7 is inserted into a circular opening 11 in the wall or bottom part 2 and is releasably fastened on the former by means of the above mentioned attaching screws, as indicated in FIG. 1 by the middle lines designated at 10*a* of the bores 10. The discharge casing 6 which will have to be replaced periodically is connected with the carrier element 7 by means of mortar which fills a gap 12 formed between the inside 8*b* of the basic body 8 and the outside 6*a* of the discharge casing 6. As becomes clear from FIG. 1, a mortar filled gap 12*a* exists also between the hollow stone 3 and the outlet casing 6.

Figure 2:
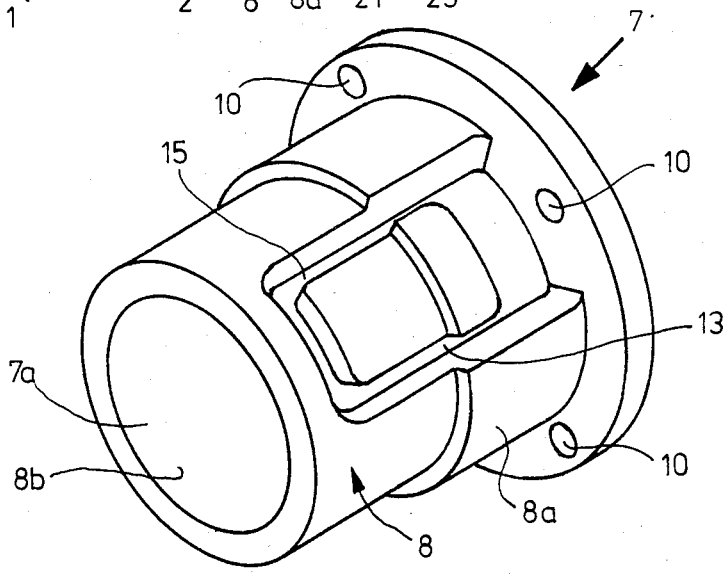

In the basic body 8 of the carrier element 7, there are two recesses 13 and 14, which are opposite one another with regard to the longitudinal axis of the base body 8 and thus also with regard to the outlet channel 5. The recesses 13 and 14 have the shape of an annular groove, which is open toward the outside 8*a* of the base body 8 as becomes clear especially from FIG. 2. These recesses 13 and 14 are closed against the inside 8*b* of the base body 8 by sections of wall 15 or 16.

A transmitter coil 17 which consists of two windings formed by conductor loops is arranged within the recess 13. The transmitter coil 17 may be connected by way of connecting conductors 18 with an AC voltage source. A receiver coil 19 is provided within the opposite recess 14, which coil consists of one winding and which is connected with an evaluation circuit by way of conductor 20.

The two coils 17 and 19 are disposed at a distance which corresponds to the thickness of the wall sections 15 and 16 from the inside 8*b* of the base body 8 and they are seperated by these wall sections 15 and 16 from the mortar layer 12 and the discharge casing 6.

Within the base body 8, a cooling channel 21 (or else several cooling channels) is provided which is connected with a cooling medium inflow line 22 only shown schematically and with a likewise only schematically indicated cooling medium outflow line 23. By allowing a circulation of suitable cooling medium, for example, compressed air, nitrogen, water or something similar, in the cooling channel 21, the carrier element 7 may be cooled. Whenever the transmitter coil 17 is fed with AC current, then the former produces a magnetic field which induces electric signals in the receiving coil 19 which are evaluated in the evaluating circuit. Since the metallic metal flowing through the outlet channel forms a shield 5, the signals induced in the receiving coil 19 are weaker in the case of a flow consisting exclusively of metallic melt than whenever slag is present in the flow in addition to the metallic melt. This means that signals induced in the receiving coil 19 change as soon as portions of slag are present in the flow of melt in the channel 5. These signal changes are determined by the evaluation circuit and are used for the purpose of closing the outlet channel 5, for example, by operating a sliding closure.

In order to avoid an undesirable influence in the magnetic coupling between the transmitter and the receiving coils 17 and 19, the carrier element 7 consists of a suitable, nonmagnetic working material. Since the carrier element 7 is exposed to a certain amount of heat, despite protection of the refractory material of the outlet casing 6, the material of the carrier element 7 should also be refractory material. Furthermore a material should be selected for the carrier element 7 which may be processed without too great difficulties. All these requirements are fulfilled for example in the case of austenitic steel and consequently this material is particularly well suited for the carrier element 7. However, as a result of the described cooling by means of the cooling medium flowing through the cooling channel 21, the temperature of the carrier element 7 may be reduced to such a point that for this element, it would also be possible to use a material which is less heat resistant than austenitic steel, for example, copper.

The two coils 17 and 19 are screened by the fire resistant outlet casing 6 against the melt flowing through the outlet channel 5 and are sufficiently far removed from the flow of melt so that an impairment of the measuring result through the action of heat is avoided. Nevertheless, the two coils 17 and 19 are close enough to the flow of melt, so that in the receiver coil 19 signals of sufficient strength will be produced. The production of the carrier element 7 and the insertion of the coils 17 and 19 into the recesses 13 and 14 may be carried out in a place suitable for such work seperate from the installation site. This means that the precise positioning of the coils 17 and 19 need not take place during the insertion into the furnace but may be carried out already in advance. The insertion of the carrier element 7 together with the coils 17 and 19 into the wall or bottom part 2 of the furnace 1 is without difficulties and little expenditure. The replacement of the coils 17 and 19 likewise presents no problems since in this case it is only necessary to replace the inserted carrier element 7 by a new carrier element.

Since, as has already been mentioned, the two coils 17 and 19 are protected by the wall sections 15 and 16 of the base body 8 from a direct contact with the mortar in the gap 12 or the refractory material of the outlet casing 6, there is no danger of damage to the two coils 17 and 19 in the case of renewal, that is to say of the breaking out of the outlet casing 6 for replacement. In the case of renewal of the outlet casing 6, the two coils 17 and 19 remain together with their carrier element 7, so that after renewal of the outlet casing 6, an expensive realignment of the measuring arrangement is not necessary.

As has been indicated in FIG. 1 by a dash dot line, it will be of advantage for the ease of insertion of the outlet casing 6 to give the latter a conically tapering shape at its end facing the hollow stone 3. The outside surface 6*a*' of the outlet casing 6 is then formed by the envelope of a truncated cone. It is understood that with such a shape of the end of the outlet casing 6, the carrier element 7 will have to be shaped correspondingly too. This means that the inside surface 8*b*' is no longer cylindrical, but defines likewise a truncated cone. Although the insertion of the carrier element 7 together with the coils 17 and 19 at the outlet of a smelting furnace 1 has been explained on the basis of the figures, it is also possible to dispose the carrier element 7 with the coils 17 and 19 attached to it in a corresponding manner at the discharge opening of a casting ladle.

What is claimed is:

1. An apparatus for determining the presence of a metallic melt in an outlet of a metallurgical vessel, comprising a carrier sleeve removably secured to the wall of said metallurgical vessel and having wall means defining an interior passage therethrough, said interior passage having a longitudinal axis;

a tubular discharge casing made of refractory material having a channel, said discharge casing extending through said interior passage and being supported by said carrier sleeve, said channel being connected to said outlet;

a transmitter supported on said carrier sleeve and having means for connection to a source of electrical power;

a receiver supported on said carrier sleeve and having means for connection to a source of electrical power;

said receiver supported on said carrier sleeve having means for connection to an evaluation circuit;

said transmitter and said receiver being arranged on opposite sides with respect to said longitudinal axis of said discharge casing and separated from said discharge casing by said wall means;

said carrier sleeve having means for securing said carrier sleeve to said metallurgical vessel about said outlet, said tubular discharge casing being removable separately and independently of said carrier sleeve for replacement thereof, with said transmitter and said receiver remaining secured on said carrier sleeve about said outlet of said vessel.

2. The apparatus as claimed in claim 1 wherein said carrier element forms a hollow cylinder.

3. The apparatus as claimed in claim 1 wherein said carrier sleeve is a non-magnetic and heat resistant material.

4. Apparatus as in claim 1, wherein the receiver (19) and the transmitter (17) are disposed at a distance from the inside (8*b*) of the carrier sleeve (7) facing the refractory body (6).

5. Apparatus as in claim 1, wherein the transmitter (17) as well as the receiver (19) are disposed in a recess (13, 14) which is closed toward the inside (8*b*) of the carrier sleeve (7).

6. Apparatus as in claim 3, wherein the carrier sleeve (7) is made of an austenitic steel.

7. The apparatus as claimed in claim 6 wherein a cooling means for cooling the carrier sleeve is provided.

8. Apparatus as in claim 7, wherein at least one channel (21) for a cooling medium is provided in the carrier sleeve (7).

9. The apparatus as claimed in claim 8 wherein said transmitter and said receiver each have at least one conductor loop.

* * * * *